United States Patent [19]

Moerkens

[11] 4,208,616

[45] Jun. 17, 1980

[54] INDUCTIVE STABILIZATION BALLAST FOR A DISCHARGE LAMP

[75] Inventor: Jozef C. Moerkens, Eindhoven, Netherlands

[73] Assignee: U.S. Philips Corporation, New York, N.Y.

[21] Appl. No.: 837,400

[22] Filed: Sep. 28, 1977

[30] Foreign Application Priority Data

Oct. 14, 1976 [NL] Netherlands ..... 7611328

[51] Int. Cl.[2] ..... H05B 41/36

[52] U.S. Cl. ..... 315/106; 315/100; 315/283; 315/309; 315/DIG. 5; 361/37

[58] Field of Search ..... 315/100, 104, 106, 276, 315/283, 309, DIG. 5; 361/37, 38, 106; 328/8, 11

[56] References Cited

U.S. PATENT DOCUMENTS 3,701,925 10/1972 Nozawa et al. ..... 315/DIG. 5

3,872,350 3/1975 Powell et al. ..... 315/104

FOREIGN PATENT DOCUMENTS 2032446 1/1972 Fed. Rep. of Germany ..... 315/106

*Primary Examiner*—Eugene R. LaRoche

*Attorney, Agent, or Firm*—Thomas A. Briody; William J. Streeter; Bernard Franzblau

[57] ABSTRACT

An inductive stabilization ballast for a low-pressure mercury vapor discharge lamp having preheatable electrodes. The ballast includes a protective device which comprises a positive temperature coefficient resistor. The inductive portion of the ballast and the PTC resistor are disposed in the ballast so as to be insulated relative to one another, both electrically and thermally. The PTC resistor is connected in series with a glow starter in the preheating circuit of the lamp electrodes. Thus, the electric current in the case of a non-starting lamp is kept at a harmless low level and, in the case of a normally operating lamp the PTC resistor does not disturb the lamp operation.

7 Claims, 3 Drawing Figures

INDUCTIVE STABILIZATION BALLAST FOR A DISCHARGE LAMP

BACKGROUND OF THE INVENTION

This invention relates to an inductive stabilization ballast for a discharge lamp and more particularly to an improved ballast circuit including a protective device for preventing damage to the discharge lamp or to the circuit components in the event that the lamp refuses to ignite.

A known inductive stabilization ballast comprises a first pair of connecting elements between which the inductive portion of the ballast is connected, the ballast being provided with at least a second pair of connecting elements and with a resistor having a positive temperature coefficient. The discharge lamp is connected in series with the stabilization ballast. An inductive stabilization ballast of the type mentioned is disclosed in U.S. Pat. No. 3,631,322. In that known ballast the resistor having a positive temperature coefficient (PTC resistor) is disposed in proper thermal contact with the inductive portion of the ballast. In addition, the PTC resistor is connected in series with the inductive portion of the ballast. There are certain disadvantages to this type of arrangement, as will be further explained hereinafter.

If the ballast is to be used in combination with a gas and/or vapor discharge lamp which is provided with pre-heatable electrodes, two current states of the ballast can be distinguished. Namely, a first current state during the starting procedure of the lamp wherein the ballast carries the preheat current for the lamp electrodes. A second current state occurs during the operating condition of the lamp in which the lamp current flows through the ballast. In the case of a normal lamp, the duration of the first state is generally considerably shorter than that of the second current state.

As the intensity of the preheating current usually exceeds that of the current in the operating condition of the lamp, the heat generation in the ballast is greatest per unit of time in the first current state. A dangerous condition therefore occurs in a ballast if, in the absense of a protective device, the lamp does not ignite sufficiently rapidly. On the other hand, if a protective device is included in the circuit, it should be energized relatively slowly so that the electrodes of a normal lamp can be preheated to a sufficient degree without the protective device being actuated.

One of the drawbacks of the known ballast is that the PTC resistor also carries current in the operating condition of the lamp, which results in power losses. The reason for this is that the PTC resistor and the inductive portion of the ballast are connected in a series arrangement, as mentioned above. Another drawback of the known ballast is that for a relatively high ambient temperature, for example in the case of a closed luminaire, the PTC resistor might prevent continuous operation of the discharge lamp.

It is an object of the invention to provide an inductive stabilization ballast of the type mentioned in the preamble wherein the PTC resistor can be heated to its high ohmic condition only during the starting procedure of the discharge lamp.

SUMMARY OF THE INVENTION

The novel discharge lamp inductive stabilization ballast in accordance with the invention comprises a first pair of connecting elements between which the inductive portion of the ballast is connected, the ballast being provided with at least a second pair of connecting elements and with a resistor having a positive temperature coefficient. The invention is characterized in that the resistor with the positive temperature coefficient is connected to the second pair of connecting elements and that, in the ballast, the PTC resistor is disposed in an insulated manner, both electrically and thermally, relative to the inductive portion thereof.

An advantage of a stabilization ballast in accordance with the invention is that it can be connected to a discharge lamp in such a way that the PTC resistor receives current only during the starting procedure of the lamp, and therefore can achieve its high-ohmic state only in the event that the lamp does not ignite. As a result, the PTC resistor does not detrimentally affect the operation of a normally operating lamp.

An inductive stabilization ballast in accordance with the invention is connected, along with the discharge lamp to be stabilized, to an electric circuit in the following manner.

The circuit comprises two input terminals, a gas and/or vapor discharge lamp which has two preheatable electrodes, and an inductive stabilization ballast in accordance with the invention. The foregoing elements are connected together so that the input terminals are interconnected by means of a first series arrangement including the lamp and the inductive portion of the ballast, and wherein the lamp electrodes are interconnected by a second series arrangement which comprises the positive temperature coefficient resistor and a lamp starter device. As a result of these connections, the inductive portion of the ballast, as well as the second series arrangement, carry the electrode preheating current during the starting procedure of the lamp, the starter device being non-conductive in the operating condition of the lamp.

If a suitable AC voltage is applied between the input terminals of this circuit, then an electric current will first flow through the series arrangement of the inductive portion of the ballast, one electrode of the lamp, the PTC resistor, the lamp starter device and the other lamp electrode. This current produces a preheating effect on the two lamp electrodes. The PTC resistor is rated so that in the case of a normally starting lamp, the temperature of that resistor is only slightly raised by the electrode preheating current. Consequently, the resistance of the PTC resistor remains in its low-ohmic range. If the lamp ignites, the lamp starter device switches the PTC resistor off again.

However, if the lamp refuses to ignite, for example, because it is an old lamp or because the lamp starter device does not interrupt the second series arrangement, then a current flows through the PTC resistor for a longer than normal period of time. This resistor is consequently heated to a degree such that it achieves its high-ohmic state. This causes the intensity of this current, which current also flows through the inductive portion of the ballast, to be reduced to a harmless low value. This low value can nevertheless be sufficient to keep the PTC resistor itself in its high-ohmic state.

It should be noted that the indicated circuit is known in itself from German Offenlengungsschrift No. 2,032,446. In accordance with the present invention, the novel ballast functions not only as a stabilizing ballast but is at the same time a container for the PTC resistor.

A combination in accordance with the present invention, i.e. of an inductive stabilization ballast with a PTC resistor, has the further advantage that it eliminates the risk that, on mounting the lamp and the ballast, a safety PTC resistor is inserted having a response time which is too slow for the inductive portion of the ballast.

In an inductive stabilization ballast in accordance with the invention, the thermal insulation between the inductive portion of the ballast and the PTC resistor can be achieved by means of a heat-insulating screen.

In a preferred embodiment of the novel inductive stabilization ballast, the thermal insulation is constituted by a hollow portion of a terminal connecting block having a synthetic resin wall, which connecting block includes the first pair of connecting elements.

An advantage of this preferred embodiment is that the connecting block then performs a double function, namely it is the container for the first pair of connecting terminals and at the same time functions as the thermal insulator between the inductive portion of the ballast and the PTC resistor.

In the electric lamp circuit mentioned above, which comprises an inductive stabilization ballast in accordance with the invention, the lamp starter device in the second series arrangement may be an electronic starter.

In a preferred embodiment of an electric circuit comprising an inductive stabilization ballast in accordance with the invention, the lamp starter device is a glow-starter. An advantage of this preferred embodiment is that the starting circuit of the lamp can then be made less complicated.

BRIEF DESCRIPTION OF THE DRAWING

The invention will be further explained with reference to the accompanying drawing in which.

DESCRIPTION OF THE PREFERRED EMBODIMENT

Figure 1:
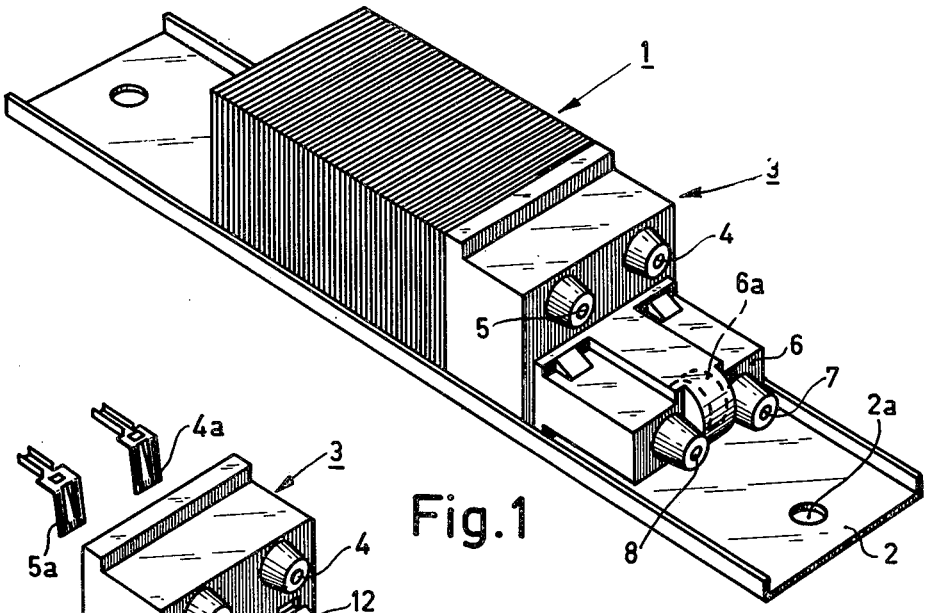
FIG. 1 is a perspective view of an inductive stabilization ballast in accordance with the invention.
Figure 2:
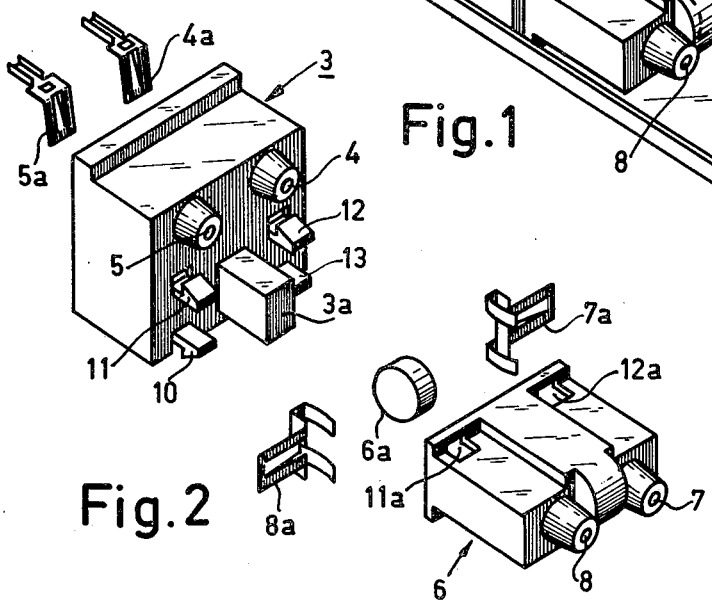
FIG. 2, shows an exploded view of a portion of the ballast of FIG. 1.

In FIG. 1, reference numeral 1 indicates the inductive portion of a stabilization ballast. This inductive portion consists of an electric winding (not shown) and a sheet-metal assembly. The inductive portion is secured to a base plate 2 which is provided at the long edges with a raised edge. Reference numeral 2*a* indicates a hole for mounting the ballast. Reference numeral 3 indicates a hollow connecting block whose walls are made of a synthetic resin material. The block 3 is provided with two holes 4 and 5 through which electric supply wires may be passed. Connecting elements 4*a* and 5*a* (the first pair of connecting elements) are disposed behind the holes 4 and 5, respectively, which can be seen most clearly in FIG. 2. The electric winding of the inductive portion 1 will be connected between these connecting elements. A container 6 houses a PTC resistor 6*a*. The container also has a synthetic resin wall. The container 6 is provided with two holes 7 and 8 and is connected to the connecting block 3 by means of a snap-connection. Behind the holes 7 and 8 are disposed connecting elements 7*a* and 8*a*, respectively (the second pair of connecting elements). FIG. 2 shows the connecting elements 7*a* and 8*a*. The PTC resistor 6*a* located in the container 6 is connected between said second pair of connecting elements. The connecting block 3 is provided with a hollow projection 3*a* (see FIG. 2). The terminal block 3 along with the projection 3*a* constitutes a thermal insulation between the inductive portion 1 of the ballast and the PTC resistor 6*a* mounted in the container 6.

In one particular embodiment the base plate was approximately 155 mm long and approximately 38 mm wide. The length and height of the inductive portion 1 were approximately 66 mm and 28 mm respectively.

In FIG. 2 the same reference numerals are used as in FIG. 1. In addition, connecting block 3 has a plurality of fastening elements 10 to 13 inclusive. These fastening elements belong to the snap-connection means by means of which the connecting block 3 is joined to the container 6. The fastening means 10 to 13 inclusive mate with holes such as 11*a* and 12*a* in the container 6. The disc-shaped PTC resistor 6*a* is enclosed by the projection 3*a* which fits into a complementary mating hollow of the container 6.

The connecting elements 4*a*, 5*a*, 7*a* and 8*a* may be plug-in contacts of a type such as, for example, are described in United Kingdom Pat. No. 1,418,362.

Figure 3:
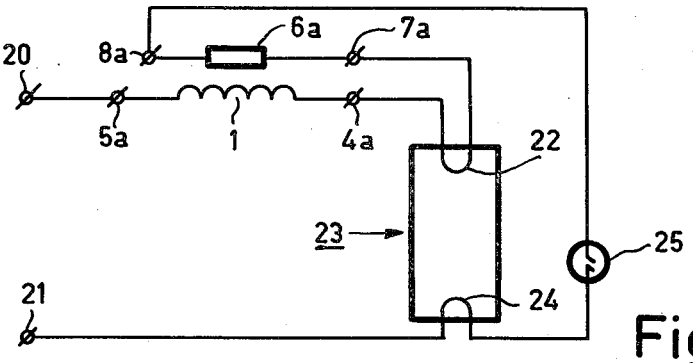
FIG. 3, is a diagram of an electric circuit in accordance with the invention comprising a discharge lamp and a ballast as shown in FIG. 1.

In FIG. 3 reference numeral 1 again indicates the inductive portion of the ballast of FIG. 1 and reference numeral 6*a* indicates the PTC resistor which is disposed in the container 6 of FIG. 1. The circuit of FIG. 3 further comprises input terminals 20 and 21 which are intended for connection to an AC electric supply of, for example, 220 volts, 50 Hertz. One end of the inductive portion 1 is connected to terminal 20 and the other end is connected to a preheatable electrode 22 of a low-pressure mercury vapor discharge lamp 23. A second preheatable electrode 24 of the discharge lamp 23 is connected to the input terminal 21. The ends of the electrodes 22 and 24 remote from the terminals 20 and 21 are interconnected by means of a series arrangement of the PTC resistor 6*a* and a glow-starter device 25.

In one embodiment, in which the ballast had the dimensions indicated in the description of FIG. 1, the lamp was a 40 Watt lamp having an operating voltage of approximately 120 volts. The self-induction of the inductive portion 1 of the ballast was approximately 1.2 Henry. The PTC resistor had a resistance value of approximately 15 Ohms at room temperature (25° C.).

In the case of a normally starting lamp 23, the ohmic value of the PTC resistor 6*a* is hardly increased at all during operation of the lamp. As the starting voltage of the glow-starter 25 is higher than the arc voltage (120 volts) of the discharge lamp 23, the shunt circuit 6*a*, 25 of the lamp 23 does not carry a current in the operating condition of the lamp.

However, if the lamp 23 does not ignite within approximately 15 seconds, the electrode preheating current which flows through the circuit 22, 6*a*, 25, 24 brings the PTC resistor 6*a* to the high-ohmic state (approximately 40 kOHms). Consequently this current is reduced to a harmless low value (approximately 5 milliamps). At that current the PTC resistor 6*a* remains in its high-ohmic range.

The ratio of the electrode preheating current to the normal lamp operating current is, in the example described, approximately 660 milliamps/400 milliamps = 1.65.

The combination in one module (see FIG. 1) of the inductive portion 1 with the PTC resistor 6*a* results in a particularly safe protection against the dangerous condition of the ballast, namely the case of a non-starting lamp.

It will be clear that if the lamp itself is a good lamp but the glow-starter 25 sticks, that is to say that its contacts can no longer separate, the protective action becomes operative owing to the fact that the PTC resistor *6a* is heated via the shunt circuit.

What I claim is:

1. An inductive stabilization ballast for a discharge lamp comprising, a first pair of connecting elements between which the inductive portion of the ballast is connected, a second pair of connecting elements for connecting the ballast to the discharge lamp and to an external starter device for the lamp, a resistor having a positive temperature coefficient connected to the second pair of connecting elements, and container means housing said first and second pairs of connecting elements, said positive temperature coefficient resistor and said inductive portion of the ballast and with said first and second pairs of connecting elements providing terminals for connecting the ballast to the discharge lamp and to the starter device, the resistor having the positive temperature coefficient being disposed within the container means so that it is insulated both electrically and thermally relative to the inductive portion of the ballast.

2. An inductive stabilization ballast as claimed in claim 1, wherein the thermal insulation comprises a hollow portion of a connecting block having a synthetic resin wall, said connecting block including said first pair of connecting elements.

3. An electric ballast circuit for a discharge lmap having two preheatable electrodes comprising, a pair of input terminals for connection to a source of electric supply voltage, a lamp starter device, an inductive stabilization ballast device comprising first and second pairs of connecting elements with the inductive portion of the ballast device connected between the first pair of connecting elements and a PTC resistor connected to the second pair of connecting elements, circuit means connecting the inductive portion of the ballast device and the lamp electrodes in a first series circuit across said input terminals, and means interconnecting the lamp electrodes by a second series circuit including the PTC resistor and the starter device so that the lamp electrode preheating current flows through the inductive portion of the ballast and the second series circuit during the starting procedure of the lamp and the starter device is made non-conductive in the operating condition of the lamp, said PTC resistor being disposed within the ballast device so as to be electrically and thermally insulated from the inductive portion of the ballast.

4. An electric ballast circuit as claimed in claim 3, wherein the lamp starter device comprises a glow-starter.

5. An electric ballast circuit as claimed in claim 3 wherein said first and second pairs of connecting elements are electrically isolated from one another within the ballast device so that the PTC resistor and the inductive portion of the ballast device are also electrically isolated from one another within the ballast device.

6. An electric ballast for a discharge lamp having two electrodes comprising, container means having first and second pairs of connecting terminals, a ballast inductor connected between said first pair of terminals and a PTC resistor connected between said second pair of terminals, said inductor and said PTC resistor being disposed within said container means so that the PTC resistor is thermally insulated from the inductor and is also effectively electrically isolated therefrom in the operating condition of the discharge lamp, a lamp starter device, means connecting the PTC resistor and the starter device in a means connecting the PTC resistor and the starter device in a series circuit across said two electrodes of the lamp so as to form a non-resonant circuit in shunt with the lamp, and means interconnecting said first and second pairs of connecting terminals so that the inductor, the PTC resistor, the starter device and the two lamp electrodes form one series circuit for connection to a pair of input supply terminals and the inductor and the lamp electrodes define a second series circuit for connection to said pair of input supply terminals.

7. An electric ballast as claimed in claim 6 wherein said first pair of connecting terminals includes first and second terminals and said second pair of connecting terminals includes third and fourth terminals, and said interconnecting means connects said first terminal to a first input supply terminal, said second and third terminals to one electrode of the lamp, said fourth terminal to one terminal of the starter device, and the second lamp electrode to a second terminal of the starter device and to a second input supply terminal.

* * * * *